US005304703A

United States Patent [19]

Pohl

[11] Patent Number: 5,304,703

[45] Date of Patent: Apr. 19, 1994

[54] PROCESS FOR DISPOSAL OF VOLATILE HAZARDOUS WASTES

[75] Inventor: Neil W. Pohl, New Richmond, Wis.

[73] Assignee: Cal-Sine Environmental, Inc., New Richmond, Wis.

[21] Appl. No.: 920,256

[22] Filed: Jul. 27, 1992

[51] Int. Cl.[5] ..... A62D 3/00

[52] U.S. Cl. ..... 588/223; 588/205; 588/213; 588/216

[58] Field of Search ..... 588/205, 213, 223, 216; 106/697

[56] References Cited

U.S. PATENT DOCUMENTS

| | | | |
|---|---|---|---|
| 4,028,130 | 6/1977 | Webster et al. | 210/52 |
| 4,118,243 | 10/1978 | Sandesara | 210/50 |
| 4,306,978 | 12/1981 | Wurtz | 210/750 |
| 4,364,773 | 12/1982 | Veronneau et al. | 423/34 |
| 4,377,414 | 3/1983 | Buschmann et al. | 106/85 |
| 4,488,971 | 12/1984 | Bolsing | 210/751 |
| 4,514,307 | 4/1985 | Chestnut et al. | 210/751 |
| 4,518,508 | 5/1985 | Conner | 210/751 |
| 4,615,809 | 10/1986 | King | 210/751 |
| 4,631,183 | 12/1986 | Lalonette et al. | 588/213 |
| 4,632,765 | 12/1986 | De Neef | 210/717 |
| 4,687,373 | 8/1987 | Falk et al. | 210/710 |
| 4,701,219 | 10/1987 | Bonee | 210/751 |
| 4,737,356 | 4/1988 | O'Hara et al. | 423/659 |
| 4,741,776 | 5/1988 | Bye et al. | 106/89 |
| 4,840,671 | 6/1989 | Lynn et al. | 210/911 |
| 4,889,640 | 12/1989 | Stanforth | 210/751 |
| 4,909,849 | 3/1990 | Funderburk | 106/90 |
| 4,911,757 | 3/1990 | Lynn et al. | 106/85 |
| 4,941,772 | 7/1990 | Roesky et al. | 106/707 |
| 4,950,409 | 8/1990 | Stanforth | 210/751 |
| 5,008,055 | 4/1991 | Holley | 106/772 |
| 5,013,458 | 5/1991 | Christy, Sr. et al. | 210/751 |
| 5,021,229 | 6/1991 | Gullett | 423/245.3 |
| 5,059,285 | 9/1991 | Somerville et al. | 210/710 |
| 5,092,929 | 3/1992 | Sauer et al. | 423/432 |

*Primary Examiner*—Michael Lewis
*Assistant Examiner*—Stuart L. Hendrickson
*Attorney, Agent, or Firm*—Ryan, Kees & Hohenfeldt

[57] ABSTRACT

A method of disposing of hazardous volatile liquid organic waste materials that includes the steps of providing a dry free flowing solid material containing lime and preferably, an organic salt of calcium, magnesium or aluminum containing about 10 to 22 carbon atoms; stirring a volatile organic liquid waste material to be disposed of therein to form a non-aqueous paste; allowing the paste to harden into a solid form that does not release the waste liquids when 100 grams thereof are placed in a 400 micron conical paint filter for five minutes: and, burning the resultant solid whereby the volatile material is burned and any hazardous metallic impurities remain in the resultant lime-based ash. The preferred organic salt component is calcium stearate.

4 Claims, No Drawings

PROCESS FOR DISPOSAL OF VOLATILE HAZARDOUS WASTES

FIELD OF THE INVENTION

This invention relates to the disposal of volatile liquid organic waste materials. More specifically, the invention relates to a method of converting such hazardous liquid materials which may contain hazardous metallic salts into a solid form that can be burned without release of the hazardous metallic compounds into the atmosphere.

BACKGROUND OF THE INVENTION

Many commercial operations, particularly those involving painting result in hazardous volatile organic waste by-products. Such wastes include solvents that contain hazardous metallic compounds such as silver nitrate, chromium compounds and the like. The presence of the metallic compounds has resulted in the prohibition of burning of said materials except under very carefully controlled conditions due to the fact that the metallic compounds can be released into the atmosphere during combustion thereby creating health-threatening environmental pollution.

Heretofore it has been necessary to transport the materials, usually for several hundred miles at great cost for purposes of disposal. Various proposals have heretofore been made to mix hazardous materials into an aqueous slurry than is hardened into a cementitious form suitable for landfill disposal. These methods suffer, however, from the possibility that both the volatile organic liquids such as paint thinners and the suspended solid metallic waste materials can eventually be leached into the soil and thus may contaminate the ground water Disposal of the waste materials has therefore continued to be a costly proposition.

SUMMARY OF THE INVENTION

It is a principal object of the present invention to convert hazardous volatile organic waste materials into a non-hazardous solid state in which they can be used as fuel pellets A related aspect of the invention is to provide such fuel pellets which during combustion retains solid hazardous metallic salts within the non-combustible solid component or ash remaining after combustion of a pellet. A further related aspect of the invention is to provide a process for disposing safely of a wide variety of hazardous organic waste materials such as paint thinners, solvents, paints, reducers, glues, adhesives, wood preservatives, varnishes, stains, wastes such as liquid components urethanes, epoxies, epoxy primers, acrylic enamels, acrylic lacquers, alkyd enamels, acrylic urethanes, and the like in a safe manner. A further aspect of the invention relates to the conversion of such materials into a pellet form which can be burned to regain the heating value of the waste material while inhibiting the release into the atmosphere of any suspended hazardous solid metallic materials.

A further related aspect of the invention is to provide a process for disposing of the hazardous wastes classified by the EPA as D001, F003, F002, D011, D006, D007, D008, or F032. A further related aspect of the invention relates to conversion of all of these hazardous liquid materials into a solid form from which the organic material does not leach but yet which can be disposed of safely by combustion. A still further related aspect involves the conversion of the hazardous waste materials into solidified pellet form in which there is no free standing liquid and from which the organic liquids do not leach.

A yet further aspect of the invention involves forming of the materials into a combustible pellet form that repels water. Yet another related aspect of the invention relates to disposing of volatile liquid materials that contain hazardous solid organic salts such as silver, cadmium, chromium, lead or arsenic salts.

Briefly summarized, the invention relates to a method of disposing of hazardous volatile liquid organic waste materials that includes the steps of providing a dry free flowing solid material containing lime and preferably, an organic salt of calcium, magnesium or aluminum containing about 10 to 22 carbon atoms; stirring a volatile organic liquid waste material to be disposed of therein to form a non-aqueous paste; allowing the paste to harden into a solid form that does not release the waste liquids when 100 grams thereof are placed in a 400 micron conical paint filter for five minutes: and, burning the resultant solid whereby the volatile material is burned and any hazardous metallic impurities remain in the resultant lime-based ash. The preferred organic salt component is calcium stearate.

DETAILED DESCRIPTION

The volatile organic industrial wastes dealt with in accordance with the present ion include those resulting from painting operations such as those used by the furniture or window manufacturing industries or any of a myriad of metallic articles that are painted during the course of manufacturing operations. The solvents used commonly include methylisobutylketone (MIBK), petroleum distillates, mineral spirits and xylene. Other examples include ethylbutylacetate, n-butylacetate, neosol, kerosene, vinyl sprays, two component paint top coats containing catalysts, polyurethane acrylic epoxy or alkyd components or finishes, other wastes include volatile organic materials that remain as by-products from various chemical processing operations. The volatile wastes can contain various metallic compounds such as silver, chromium, mercury, lead, arsenic, antimony, cadmium, molybdenum, cobalt, manganese or various heavy metals, any or all of which are hazardous if discharged into the atmosphere, for example, by conventional combustion operations. Due to these problems, disposal of the materials has been a costly proposition.

In accordance with the present invention, the volatile, metal compound containing organic materials are bound in a matrix material, the major component of which a weight basis is lime. Ordinary barn lime which consists of approximately 97–98% by weight of calcium carbonate or quick lime is satisfactory for this purpose. A dry non-leaching solid can be formed using lime alone in the case of some organic waste liquids. However, in accordance with the preferred embodiment of the invention, it has been found that a solid water repellant form of pellet can be formed by using a mixture of lime and an organic salt of magnesium, calcium or aluminum in which the organic component of the salt has between 10 and 22 carbon atoms. The preferred such salt material is calcium stearate. Other calcium salts having between about 10 and 22 carbon atoms can be substituted, however. The most notable of these are calcium palmitate and calcium oleate. Magnesium or aluminum stearate, palmitate or oleate can also be substituted. The other salts having between 10 and 22 carbon atoms can also be substituted.

While the exact mechanism of the present invention is not fully understood, it appears that the volatile organic materials when mixed with lime and the metallic organic salts referred to in a non-aqueous mixture appear to have some affinity for the matrix materials which appear to have a degree of water repellency.

In accordance with the invention the matrix material containing lime and the metallic organic salts such as calcium stearate are mixed together in a dry particulate form. After mixing, the materials revert to a solid state from which no free liquid is leached, as determined by the paint filter test protocol wherein a 100 ml sample of a composition containing the volatile waste material is placed in a 400 micron conical paint filter for five minutes. Compositions of this invention are non-aqueous and thus no water passes through the filter. Surprisingly, however, no volatile organic material passes through the filter. This is true even when the test is conducted for a period of several hours rather than only five minutes.

The solid pellets obtained by the process of this invention can be safely disposed of by combustion on many industrial premises. The invention further provides pellets which when combusted provide a means for recovery of fuel values from the waste organic materials. It is also believed that the organic salt constituent of the matrix material is also combusted to form carbon dioxide and water. Any suspended hazardous metal salt materials remain trapped in the ash component which ash is primarily composed of lime and which depending on the type of metal organic salt used can also contain magnesium oxide or aluminum oxide. The preferred compositions of the present invention include a matrix or binder material that contains one part of calcium stearate by volume to one to four parts of lime. Since the lime is more dense, the lime will constitute an even larger percentage of the material on a weight basis. It is preferred that one part of volatile waste material mixed with three to four parts by volume of the binder material.

The binder material is in the form of a free flowing solid which may be described as granular or powdery in form. While particle size is not critical, it is preferred that the materials be relatively finely divided granules or powder to facilitate mixing of the ingredients.

Any method of mixing the materials can be employed on a commercial basis. Grinding as in a hammer mill or by use of a shredder are examples of suitable mixing procedures. For easy combustion, it is preferred that the material be formed into pellets or briquettes similar in size to those used for other fuels such as coal, charcoal or the like.

Specific examples illustrating the practice of the invention are set forth in the following examples.

EXAMPLE 1

A hazardous waste material recovered from a commercial painting operation and containing volatile methylisobutylketone (MIBK) with suspended silver nitrate and other suspended solids was mixed in the ratio of one part of the volatile waste material to three and one-half parts by volume of a mixture containing 50% by volume of Hurlbut Non-Slip Barn Lime produced by Great Lakes Calcium Corporation of Green Bay, Wisc. which according to the manufacturer consisted of approximately 98% by weight calcium carbonate and an equal amount by volume of calcium stearate 15F sold under the trade name SYNPRO® by Synthetic Products Company of 1000 Wayside Road, Cleveland, Ohio. The lime and the calcium stearate were completely mixed by tumbling. The mixture was added as a powdery material free of water to the volatile organic material and stirred to form a paste. The paste hardened at room temperature within approximately five minutes. One hundred milliliters of the resultant solid material was placed in a 400 micron conical paint filter for a period of four hours without leaching of any of the liquid material. No free standing liquids were visible. The pellets could be burned at an elevated temperature. Once combustion was initiated the pellets supported a flame. After combustion the silver nitrate and other solid metallic waste materials were found to be contained within the calcium containing ash but remained after combustion.

EXAMPLE 2

The same waste material was mixed with the following calcium containing materials: (a) 1.5 parts by volume of Hurlbut Non-Slip Barn Lime to 1 part of calcium stearate 15F; (b) 2 parts of Hurlbut Non-Slip Barn Lime to 1 part of calcium stearate 15F; (c) 2.5 parts of Hurlbut Non-Slip Barn Lime to 1 part of calcium stearate 15F; and (d) 3 parts of Hurlbut Non-Slip Barn Lime to 1 part of calcium stearate 15F. Each of the resultant mixtures hardened into a pellet on which no free liquid was observed and from which no liquid leached when tested in a conical filter as described in Example 1.

Best results were obtained by adding 3.5 parts by volume of the calcium binder material to 1 part by volume of the volatile hazardous waste material.

What is claimed is:

1. A method of disposing of hazardous metal compound containing volatile liquid organic waste materials consisting essentially of:

providing a dry, free flowing solid material consisting essentially of a mixture of lime or calcium carbonate and an organic salt of calcium, magnesium or aluminum having between 10 and 22 carbon atoms, stirring a volatile organic liquid waste material therein to form a non-aqueous paste, allowing said paste to harden into a solid form that does not release said volatile liquid organic waster material when 100 grams thereof are placed in a 400 micron conical paint filter for five minutes, and burning said resultant solid whereby said volatile liquid organic waste material is burned and the residue of said solid material remains as an ash.

2. A method according to claim 1 wherein the free flowing solid material comprises a mixture of barn lime and said calcium, magnesium or aluminum salt.

3. A method according to claim 2 wherein said calcium salt comprises calcium stearate.

4. A method according to claim 3 where said calcium carbonate or lime and calcium stearate are present in said material in approximately equal amounts by volume.

* * * * *